US005454642A

United States Patent [19]

De Luca

[11] Patent Number: 5,454,642

[45] Date of Patent: Oct. 3, 1995

[54] INFLATABLE FLAT BAG PACKAGING CUSHION AND METHODS OF OPERATING AND MAKING THE SAME

[75] Inventor: Nicholas P. De Luca, Bethesda, Md.

[73] Assignee: Novus Packaging Corporation, Jamaica Plain, Mass.

[21] Appl. No.: 92,750

[22] Filed: Jul. 16, 1993

[51] Int. Cl.[6] ..... B65D 81/00; B65B 23/00

[52] U.S. Cl. ..... 383/3; 206/522; 53/472

[58] Field of Search ..... 383/3, 38, 39, 383/41, 92, 95, 98; 410/119; 206/522; 53/472

[56] References Cited

U.S. PATENT DOCUMENTS

| | | | |
|---|---|---|---|
| 3,357,632 | 12/1967 | Stanforth | 383/3 |
| 3,554,135 | 1/1971 | Duvall et al. | 410/119 |
| 3,889,743 | 6/1975 | Presnick | 206/552 X |
| 4,465,188 | 8/1984 | Soroka et al. | 383/3 X |
| 4,551,379 | 11/1985 | Kerr | 206/522 X |
| 4,872,558 | 10/1989 | Pharo | 383/3 X |
| 4,874,093 | 10/1989 | Pharo | 383/3 X |
| 5,042,663 | 8/1991 | Heinrich | 383/3 X |
| 5,263,587 | 11/1993 | Elkin et al. | 206/522 |

FOREIGN PATENT DOCUMENTS

| | | | |
|---|---|---|---|
| 848248 | 9/1960 | United Kingdom | 383/3 |

*Primary Examiner*—Horace M. Culver
*Attorney, Agent, or Firm*—Rines and Rines

[57] ABSTRACT

An inflatable protective packaging for articles comprising a pair of adjacent flat bag chambers with an intermediate inflation channel therebetween communicating at an inner end with the chambers and having an outer inflation opening preferably independently sealable for each bag chamber at the outer end of the channel. The item may be formed as successive flat, servable units on a roll, or integrated with envelopes or boxes.

21 Claims, 9 Drawing Sheets

Figure 1A:
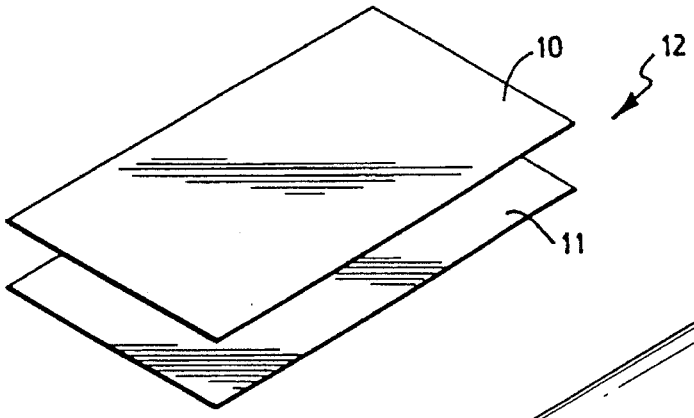

INFLATABLE FLAT BAG PACKAGING CUSHION AND METHODS OF OPERATING AND MAKING THE SAME

TECHNICAL FIELD

The present invention relates generally to a packaging system for protecting and cushioning articles to be shipped or stored, and more particularly to inflatable bags provided with multiple separate chambers that are inflated so as to retain, protect and cushion an article between them.

BACKGROUND OF INVENTION

The use of inflatable cushions for packaging goods has been known in the packaging art for some time, although not heretofore widely used commercially in the packaging industry. U.S. Pat. No. 3,521,743, issued on Jul. 28, 1970 to Carlo J. Sposito, Jr. for "Cushion Package", for example, discloses an inflation packaging system comprising two air cushions. Likewise, U.S. Pat. No. 4,905,835, issued on Mar. 6, 1990 to Alain Pivert and Michael L. Pezzo for "Inflatable Cushion Packaging" also employs two separate inflatable structures used to package articles. One commercially available inflatable envelope device, called "Airtex", is manufactured by Air Packaging Technologies in Valencia, Calif., referencing U.S. Pat. Nos. 4,874,093 4,872,558 and 4,918,904.

In packaging articles between inflated cushions, in outer boxes, it is advisable that both cushion air chambers be isolated from one another. In a package where air communication is permitted between air cushions, protecting an article, as in the "Airbox" envelope, in which the chambers communicate through a hole, after the package is maintained in the same position for some time, the pressure gradient between cushions, caused by the weight of the article on one cushion, is equalized by the deflation of the support cushion and the inflation of the top cushion; the article thus being displaced downward towards the outer box wall, particularly for relatively heavy articles. Thus, the use of two isolated chambers is preferentially necessary to prevent air passage from one chamber to another and thus maintain the position of the article.

Some of the prior arc has accomplished this function of maintaining two separate air chambers by employing two distinct cushioning members that can be inflated either separately or simultaneously with tubing systems incorporating valves. The costs associated with the use of two distinct cushioning members, tubing, and valves, has, to date, however, proved too expensive for wide-spread use in industry.

The present invention is accordingly directed to the solution of the problem of providing an inexpensive inflation cushioning system that comprises at least two air chambers that can be filled simultaneously without the use of special tubing or valves, and that can then be independently sealed, the structure being readily formed, at low cost, from a single flat bag envelope, while minimizing the volume of required material.

OBJECTS OF INVENTION

An object of the invention, accordingly, is to provide a new and improved packaging, protecting and cushioning system and structure for articles to be shipped or stored, and novel methods of using and operating the same, that admirably overcome the above-described and other problem's with prior cushioning structures.

A further object is to provide such a novel cushioning structure embodying an inexpensive thin planar flexible bag formed into a pair of adjacent inflatable chambers foldable about the article to be protected.

Other and further objects will be explained hereinafter and are more particularly delineated in the appended claims.

SUMMARY OF INVENTION

In summary, the invention employs an inflatable protective package for enveloping and cushioning articles for shipping or storage having, in combination, an initially substantially flat thin bag having upper and lower planar flexible surfaces peripherally sealed to form a pair of adjacent flat bag chambers intermediately joined by a common flat inflation channel therebetween communicating at an inner end with the interior of each chamber, with the flat chambers being foldable along the inflation channel as a vertex to provide an angular space between the chambers for receiving therein the article-to-be protected; the flat inflation channel being flexibly bendable out of the plane of the bag rearwardly of the vertex fold between chambers to permit the outer end of the channel to be connected to a filling source to inflate the chambers and provide a protective cushioning about the article.

The packaging system of this invention comprises a flat bag or envelope thus formed into two or more adjacent inflation chambers that unite at a single fill opening. The flat bag is made from a single flattened, thin-film preferably thermoplastic tubular structure, or from two or more joined thin film thermoplastic sheets defining such structure. Adhesive strips may be placed along the edges of the bag face on which the article rests, so as to keep the bag closed when it is folded over the article. Adhesive strips may also be placed on that portion of the bag that rests on the outer box so as to prevent shifting of the bag from its original placement in the box. The chambers in the bag are intended to be substantially filled with a filler medium, such as pressurized air, a low thermal conductivity gas such as carbon dioxide, or a high thermal conductivity liquid such as water, or other filler through a single opening, and then each chamber sealed after inflation. The article is suspended within the space between the cushioning chambers.

In carrying forth the invention, the flat bag is first formed into at least two chambers joined at a single opening in a common, but divided inflation channel disposed between the adjacent bag chambers. Prior to packaging the article, the bag may be formed singularly or as part of a roll of similar bags, or it may be preplaced within a box. Following placement of the article between the chambers, the chambers may be inflated either prior to or subsequent to placement of the article and liner within a box or package. Depending on the packaging application, the article may first be sandwiched between the folded bag that is already nested in the box. The inflation opening is extended outside of the box through a small opening in the box that is either a standard attribute of the box or created at the time of packaging. The box is subsequently closed and sealed and the bar chambers filled and sealed. In some packaging applications, it may be convenient first partially to fill the bag chambers prior to sealing the box. The narrow opening region in the inflation channel acts as a temporary one-way valve during filling. The permanent sealing of each chamber may be performed by thermal means or via mechanical means such as a clip, as later described. A self-sealing valve may also be used.

Preferred and best mode embodiments and designs are hereinafter presented.

DRAWINGS

Figure 1B:
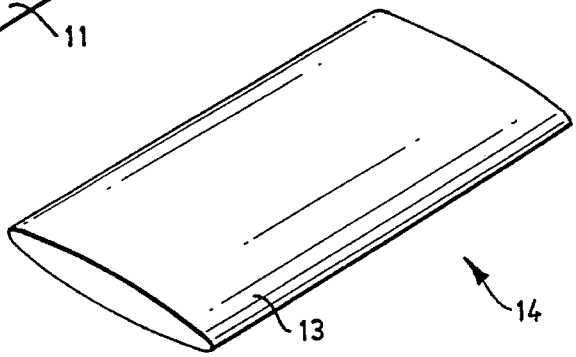
Figure 2A:
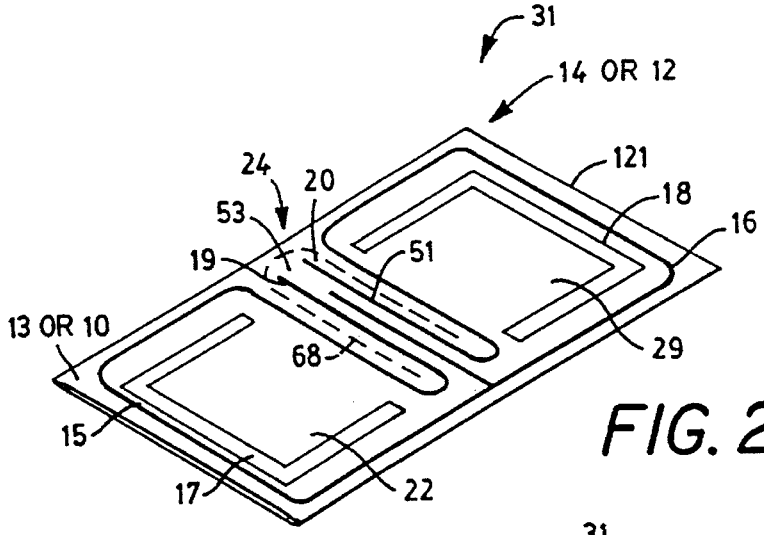
Figure 2B:
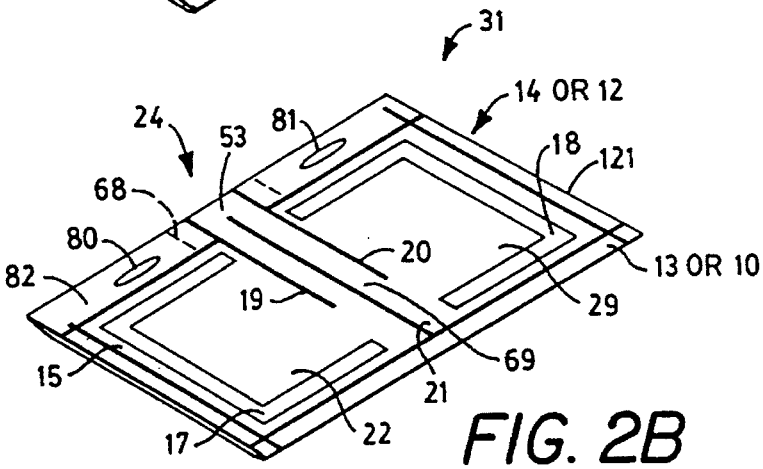
Figure 3A:
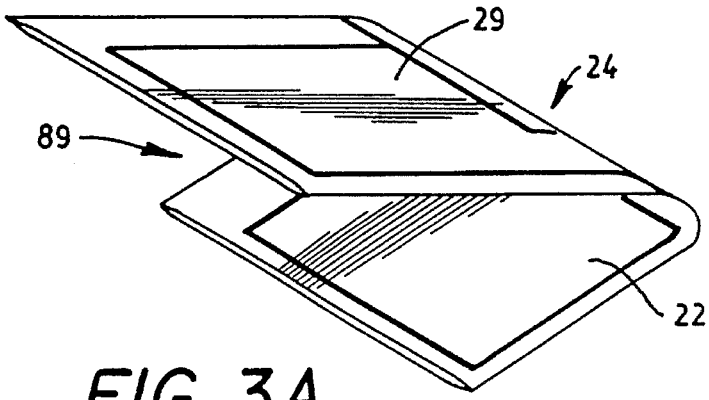
Figure 3B:
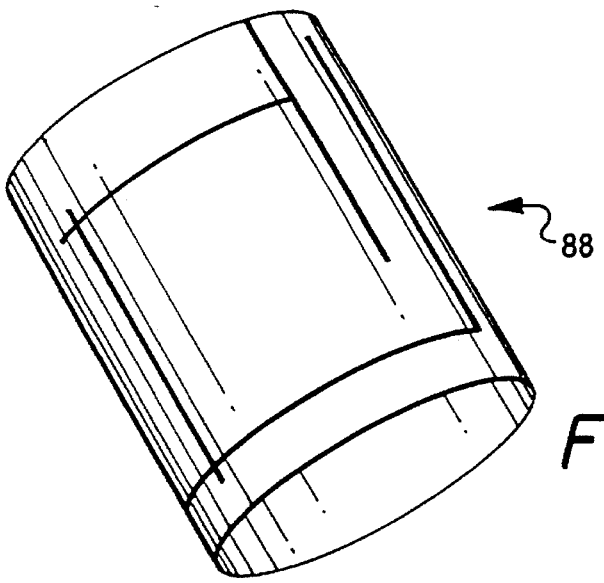
Figure 3C:
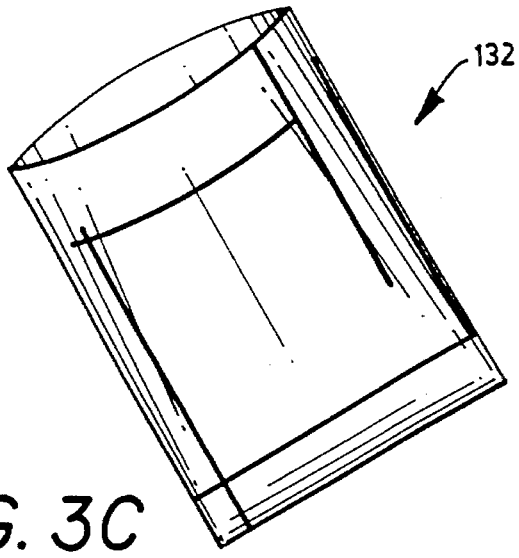
Figure 4A:
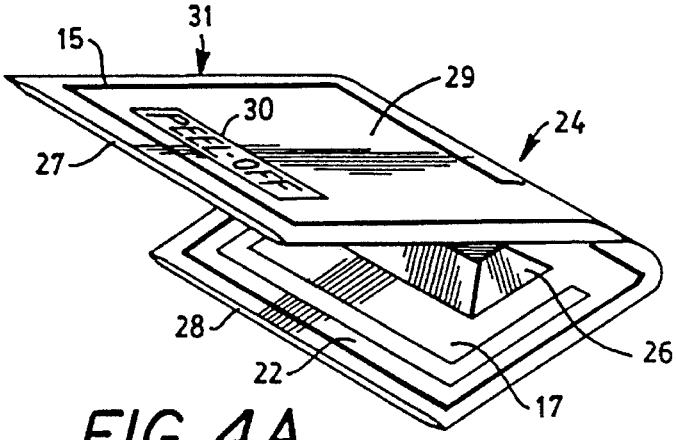
Figure 4B:
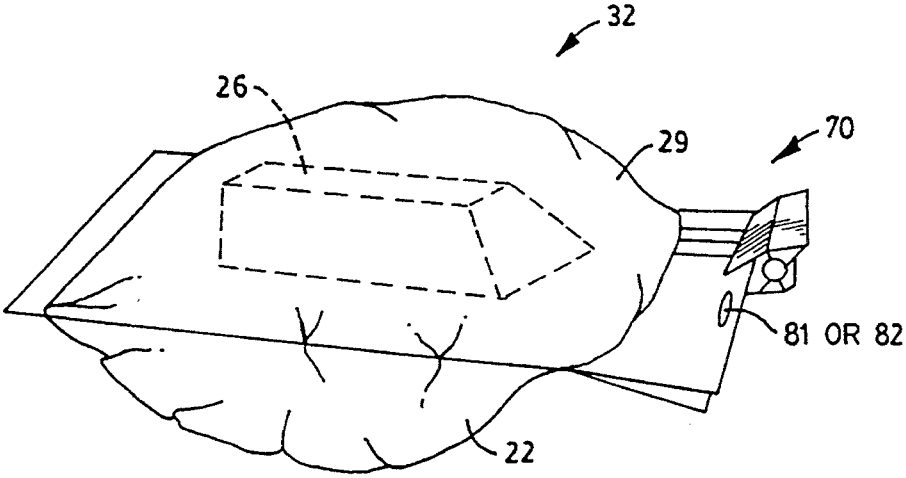
Figure 4C:
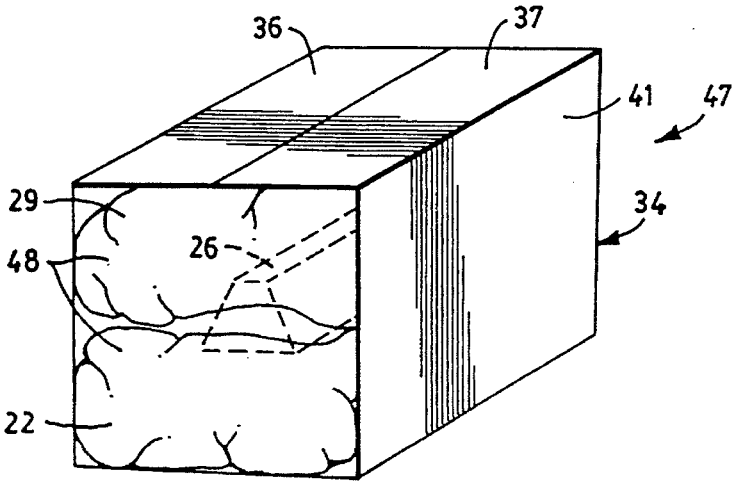
Figure 5A:
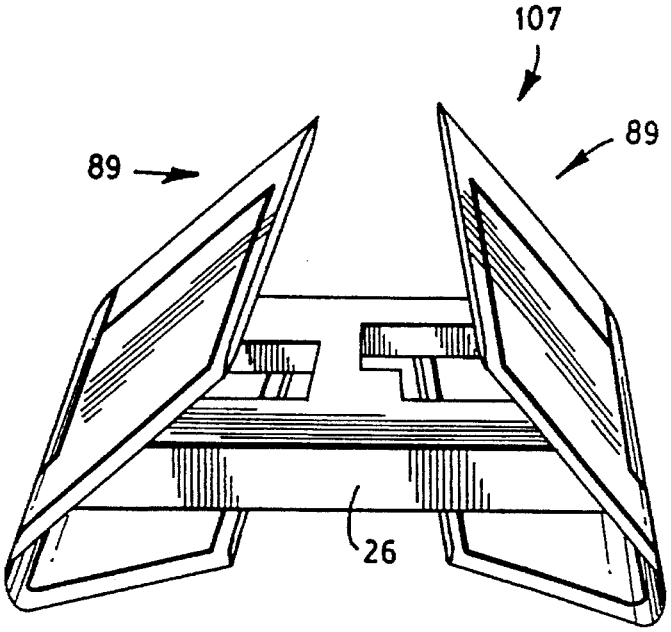
Figure 5B:
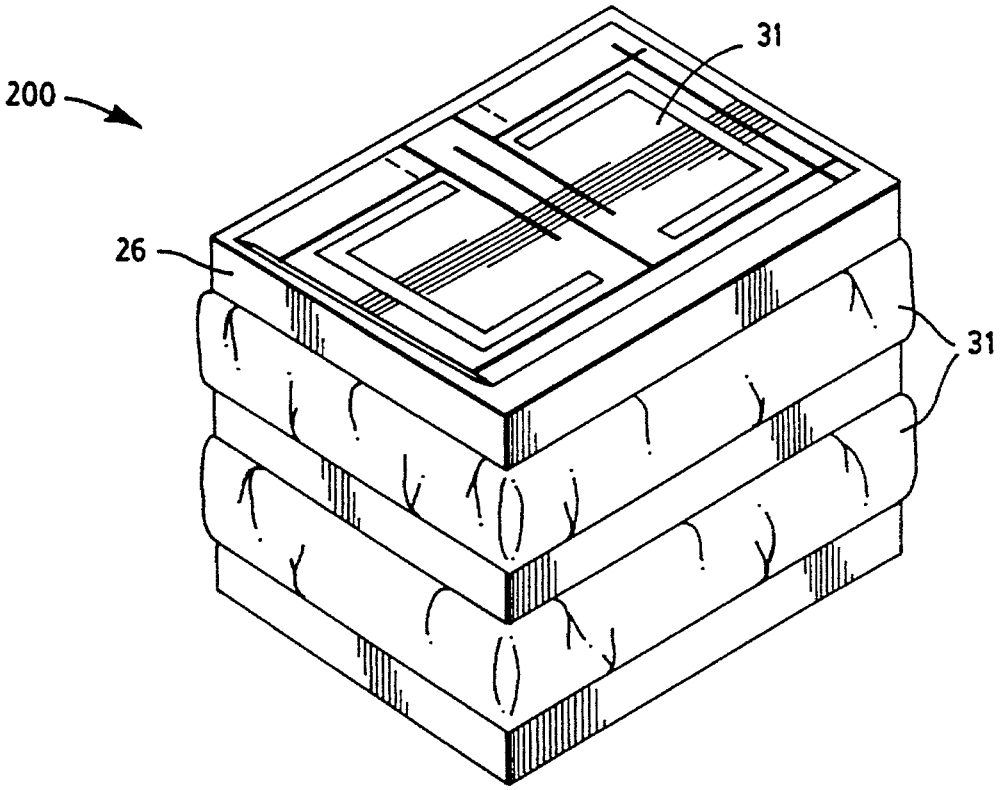

The invention will now be described in connection with the accompanying drawings wherein:

FIGS. 1*a* and 1*b* are isometric views illustrating respective flat sheet and tubular forms that may be used to make the packaging system of the invention;

FIGS. 2*a* and 2*b* are isometric views illustrating two possible embodiments of the sealing pattern comprising adjacent inflatable chambers and intermediate divided inflation channel in a common flat surface;

FIGS. 3*a*, 3*b*, and 3*c* are isometic views illustrating the bag of FIG. 2*a* modidified into an envelope form, a sleeve, and a fold-over form, respectively, to form a protective package;

FIGS. 4*a*, 4*b*, and 4*c* are isometric views of the package of FIG. 3*a* being folded around an article to be protected, inflated around the article, and placed in a box with the article, respectively;

FIGS. 5*a* and 5*b* are isometric views illustrating means for packaging and article by using more than one of the bags illustrated in FIG. 2*a;*

Figure 6A:
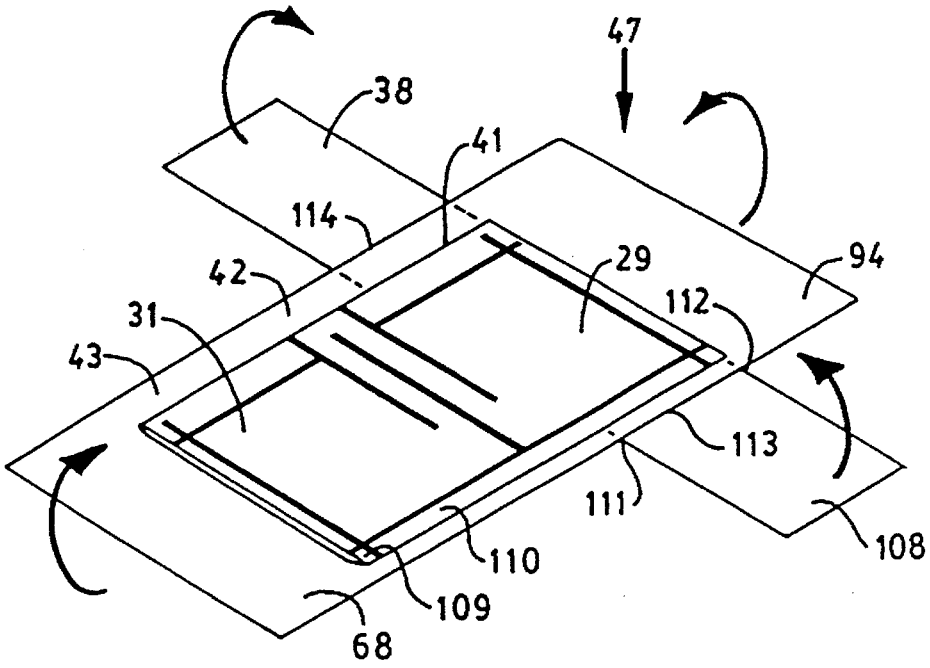
Figure 6B:
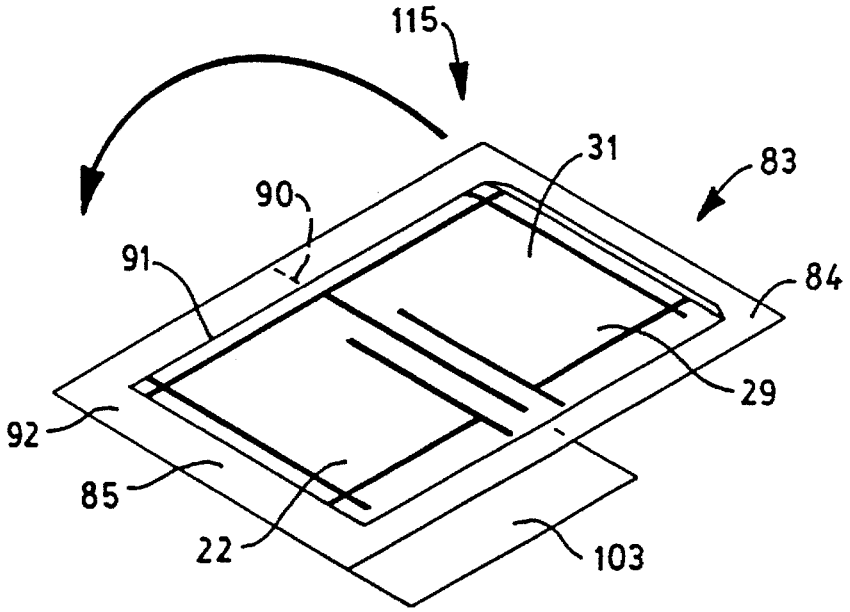

FIGS. 6*a* and 6*b* are isometric view of the bag in FIG. 2*b* integrated with a box or envelope, respectively.

Figure 7:
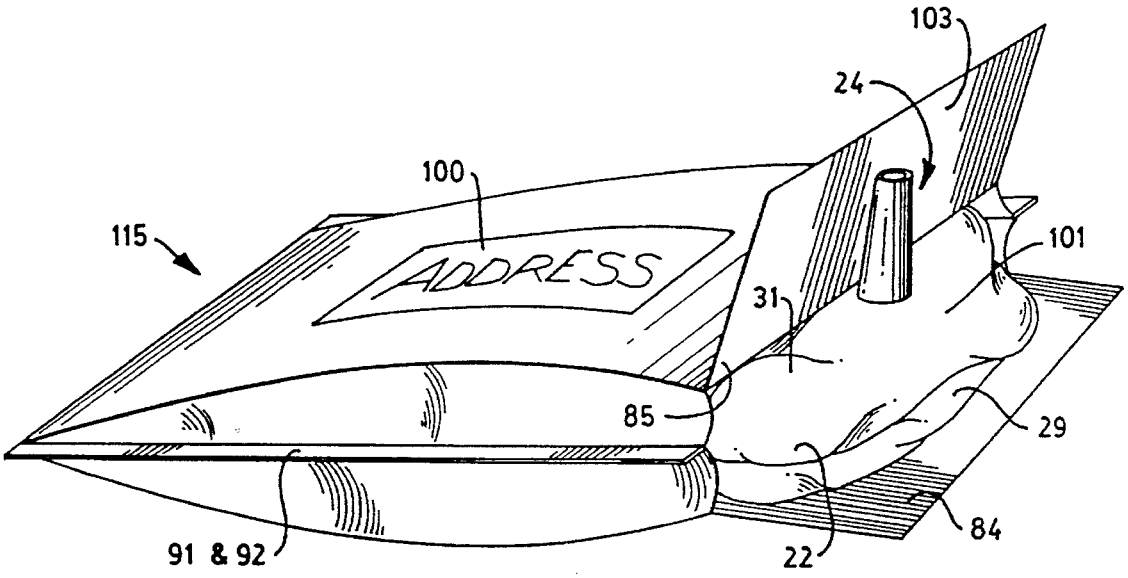

FIG. 7 is an isometric view showing the integrating of either bag illsutrated in FIG. 2*a* and FIG. 2*b* with an envelope as described in FIG. 6*b;*

Figure 9A:
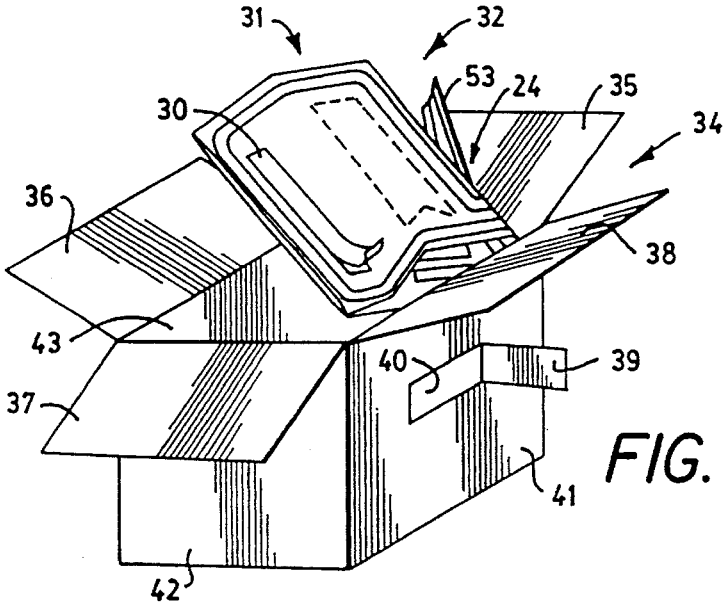
Figure 9B:
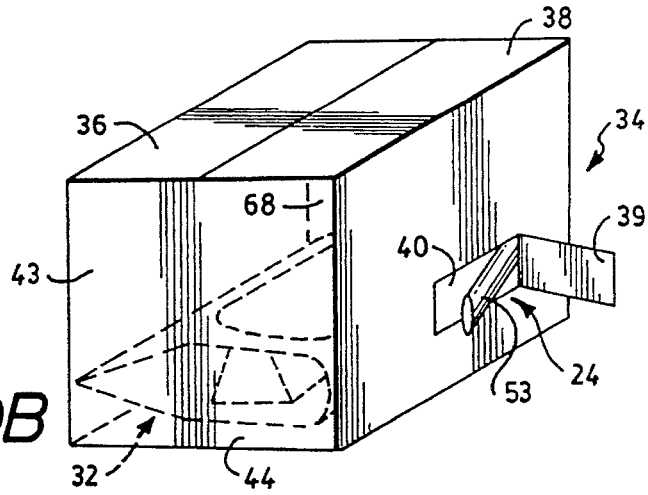
Figure 9C:
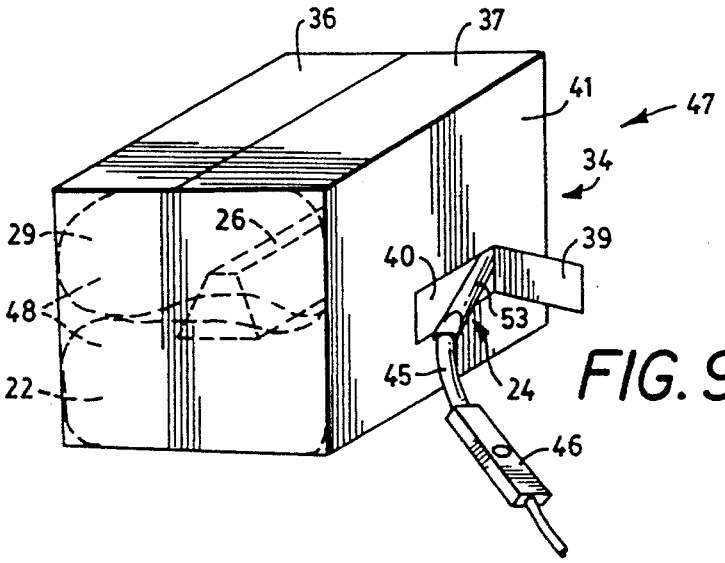
Figure 10:
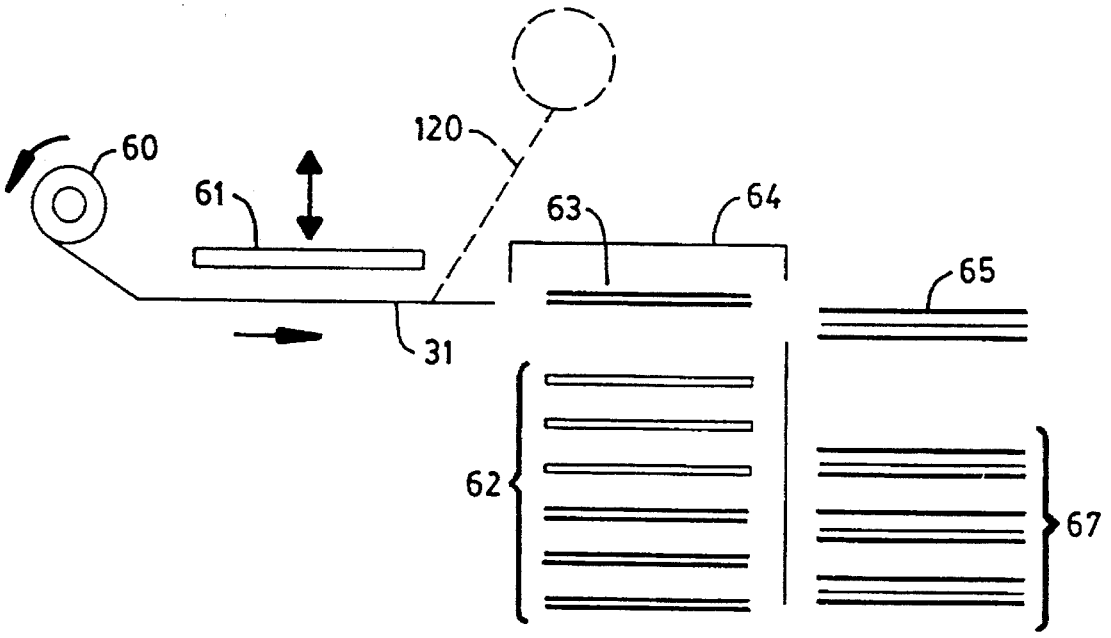

FIGS. 8*a*, 8*b*, 8*c*, 8*d* and 8*e* are isometric views illustrating methods of permanently sealing the filling channel;

FIGS. 9*a*, 9*b* and 9*c* are isometric views illustrating the insertion of the formed bag and article of FIG. 4*a* into a box, the disposition of the formed bag and an article of FIG. 4*a* inside the box, and the exterior filling of the formed bag and the disposition of the article inside the box once the bag is filled, respectively, and FIG. 10 is a block diagram illustrating a means of making the packaging system of FIGS. 2*a* and 2*b* and inserting this packaging system within a box or envelope.

PREFERRED EMBODIMENT OF THE INVENTION

FIGS. 1*a* and 1*b* illustrate preferred thin plastic sheet material used to make the multi-chamber flat bag liner 31 for the ultimate packaging system shown in FIGS. 4*a*, 4*b*, 4*c*, 5*a*, 6*a*, 7, 9*a* and 9*c*; FIGS. 1*a* showing a pair of upper and lower planar flexible sheets 10, 11, that may be peripherally and intermediately heat-sealed to form the bag chambers 22 and 29 of FIGS. 2*a* and 2*b*. The initial unformed bag may be formed by tacking the edges of the parallel sheet panels 10 and 11, FIG. 1*a*, as by thermal or mechanical means, and then forming into adjacent sealed chambers 22, 29, FIGS. 2*a* and 2*b*. The flat bag 14, FIG. 1*b*, may also initially take the form of a single extruded or blown tube.

The preferable material of sheet panels 10 and 11 as well as tubular form 13 used to form the modified bag 31 is one that is impermeable to gases and provides sufficient elasticity, flexibility and strength for the packaging system 47, FIGS. 4*c* and 9*c*. Suitable materials include coextrusions of nylon with other thermosplastics, as well as metalized films, polyvinyl chloride, ethylene vinyl alcohol, rubber or heat-treated polyethylene, as examples. The least expensive material found to date that maintains an acceptable level of air permeability is a co-extruded film of nylon and polyethelene; maintaining a level of oxygen transfer of 1.5 cc/100 in2/24 hrs at 73 degrees Fahrenheit (ASTM standard d-3985). The use of co-extruded polyethylene-nylon film ranging in thickness from 0.001 to 0.015 inches is the most preferable for using the packaging system to transport most common items ranging in weight from less than 1 pound to the order of 1000 pounds.

FIGS. 2*a* and 2*b* illustrate the general sealing patterns 15 made on the unmodified film 12 or 14. Seal 15 is most preferably made by thermosealing but can also be made using adhesives. The general sealing pattern is usually symmetrical about the width or length of the flat bag 12 or 14 and forms at least a pair of adjacent flat bag planar chambers 22 and 29, FIGS. 2*a* and 2*b*, formed by peripherally sealing along 15, preferably in generally rectangular shape, and intermediately joined by a common flat inflation channel 24 there between. The corners of the seal may be rounded as at 16 so as to distribute the stress around the corner and avoid stress concentrations during the inflation filling, as in FIG. 9*c*.

Chambers 22 and 29 are connected to the inflation channel 24 that is formed by the sealed extensions 19, 20 and 21. The chambers 22 and 29 are connected to their inner adjacent lower corners to the inner end of the common inflation channel 19, 20, with divider partition 21 forming separate inflation filling tubes 19–21 and 21–20 for the respective chambers 22 and 29 to enable independent inflation and then a single seal that prevents communication between the inflated chambers. The inflation channel outer or filling end opening 53 for the chambers 29 and 22 may extend beyond the edges of the bag as in FIG. 2*b*, or may be formed by severing the material at the ends of seals 19 and 20 and cutting along path 68, which may be serrated or provided with tear perforations as in FIGS. 2*a* and 2*b*. Holes 80 and 81 may be formed in lateral edge 82 as means for hanging the folded envelope form of FIG. 4*c*.

As more particularly shown in FIG. 3*a*, the flat uninflated chambers 22 nd 29 are foldable along the intermediate inflation channel 24 as a vertex line, forming an angular space 89 between she chambers for receiving therein the article 26 to be protected, as shown in FIG. 4*a*. As shown in FIGS. 3*b* and 3*c*, the flat modified form 31 may be further modified to creat a sleeve 88 or envelope 132. The flat inflation channel is flexibly bendable out of the plane of the bag rearwardly of she vertex fold 24, FIGS. 9*a*, 9*b*, and 9*c*, to permit the outer end opening 53 to be connected to a filling source; for example, external to a shipping container box 34 in which the cushioned article is to be inserted, FIGS. 4*c* and 9*a*, 9*b*, and 9*c*. This permits the channel 24 to be extended through a slot 39–40 in the box, shown in FIGS. 9*b* and 9*c*, enabling filling with one external hose 45, FIG. 9*c*, through the inflation channel outer end opening 53. Seal 21 ends preferably several inches away from the ends of seals 19 and 20 (FIGS. 2*a* and 2*b*) and forms a "Y" channel to enable simultaneous filling of both chambers through one opening. The cross dimension of the opening 53 is made much smaller than the length of the inflation channel tubes 19–20–21 and is preferably somewhat tapered, as shown in FIG. 2*a*. After filling the chambers with a filler medium 48, such as air, the chambers 22 and 29 are sealed in region 51, via means such as are shown in FIGS. 8*a*, 8*b*, 8*c*, 8*d*, and 8*e*, and 9*c*, thus independently separating the chambers from the air flow. This separation at region 51 is crucial to maintain the packaged article in a suspended position as before explained.

An adhesive area(s) 17 and 18 may be employed on surface 13 or 10 comprising a peel-off double stick adhesive tape, for example, that is used temporarily holding or securing chambers 22 and 29 together at edges 27 and 28, FIG. 4*a*, about the article 26, while preparing the article 26 for shipment during the filling of FIG. 9*c*. Area 17 can also serve to hold or secure the article directly to surface 10 or 13 through a non-destructive temporary adhesive, such as a polymer. An additional peel-off adhesive region 30, FIG. 4*a*, may also be located at the external underside of surfaces 11 and 13 for use in temporarily securing the packaged system 32 to one or more of the internal surfaces 35, 36, 37, 38, 41, 42, 43, 44, 68, of the containing box 34, FIG. 4*c*, while filling is effected as shown in FIG. 9*c*. The adhesive regions can be exposed by using a non-stick peel-away release liner 30, or may be applied to the internal surfaces 35, 36, 37, 38, 41, 42, 43, 44, 68, of the box 34, FIG. 9*a*, prior to or during packaging.

FIG. 4*a* illustrates the open form package 32, FIG. 3*a*, after article 26 has been placed between cushions 29 and 22. In FIG. 4*b* clip 70 permits the channel 24 to be sealed and unsealed without damaging the liner; thus allowing reuse of the package. FIG. 4*c* illustrates the sealed packaging system placed within a box 34 with box panels 36 and 37 being firmly closed by standard adhesive tape means.

FIG. 5*a* illustrates the packaging of article 26 by using more than one folded bag 89 enveloping different portions of the article. This is particularly useful for oddly shaped articles or parts. Package 107 can further be initially inflated as in FIG. 4*c* or deflated as shown in FIG. 9*a* prior to insertion within the box 34. FIG. 5*b* illustrates the packaging system 200 in which more than one liner 31 is placed between stacked articles so as to provide protection between articles during shipping. Package 200 can be further placed within an exterior container 47, FIG. 4*c*. In certain applications, the liners 31 may be partially inflated prior to insertion into exterior container 34, FIG. 4*c*, and further inflated through a plurality of holes 40, FIG. 9*c*.

FIGS. 6*a* and 6*b* illustrate the integration of bag liner 31 with a box blank 47 and an envelope 83. Adhesive means such as 30, FIG. 9*a*, maybe used to secure the liner 31 to the box 47 and envelope 83. Folding and sealing of the box 47 and envelope 83 as indicated by the arrows, is usually performed prior to inflation of liner 31. The box can be formed by folding panels 68, 43, 42, 41, 38, and 108 along the edges 109, 110, 111, 112, 113, and 114, respectively, and the box, can be secured by adhesive between surfaces 68 and the underside of 94; the end portions of box 34 can be secured by positioning surfaces 108 and 38 perpendicular to surface 41 and securing to the underside of surface 68. Envelope 83 may be formed by folding panels 84 and 85 along edge 90 and then sealing between edges 91 and 92. The incorporation of the bag liners in the box blank can be automated as shown in FIG. 10.

FIG. 7 illustrates the packaging system of FIG. 6*b*, comprising the liner 31 and the envelope 83, wherein panels 84 and 85 have been sealed together forming a closed envelope. Generally, an article is placed within the envelope 83 between the chambers 22 and 29 of liner 31 through opening 101. The liner is then inflated through channel 24 and sealed with methods illustrated in FIGS. 8*a* through 8*e*. Opening 101 is further secured to the underside of panel 85 using standard adhesive means, such as packaging tape or adhesive means, such as packaging tape or adhesive means, placed on surface 103. Inflation of liner 31 may also be performed after covering of opening 101 with surface 103. An address label may be placed on the underside of surface 84 for shipping purposes as at 100.

Figure 8A:
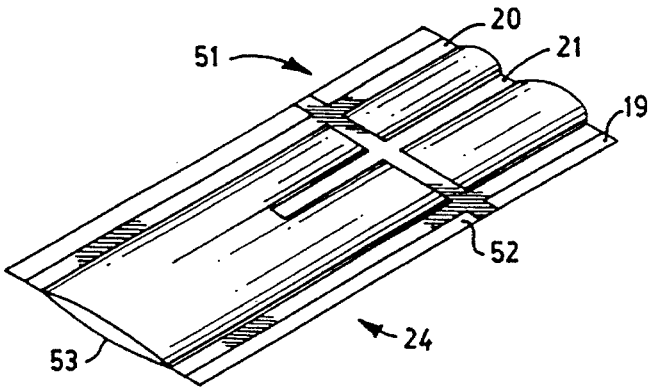
Figure 8B:
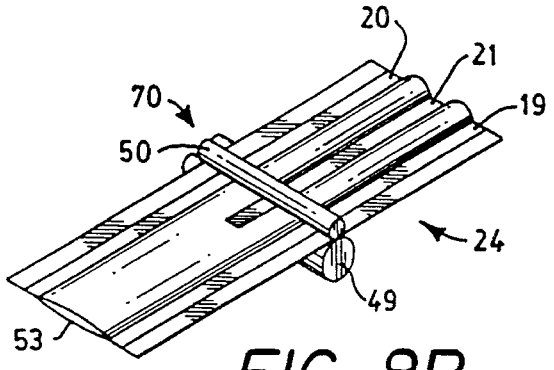
Figure 8C:
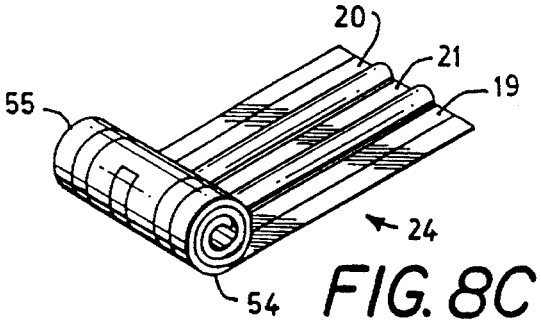
Figure 8D:
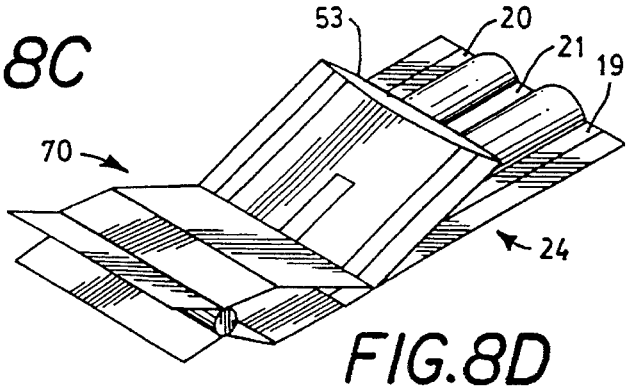

FIGS. 8*a*, 8*b*, 8*c*, 8*d* and 8*e* illustrate some of the possible techniques for permanently sealing channel 24 after filling. FIG. 8*a* illustrates a thermal seal 52 performed in region 51. FIGS. 8*b* and 8*c* illustrate a seal in region 51 of channel 24 performed by mechanical means employing a clip 70 comprises two mating sections 49 and 50. Channel 24 is sealed through compression between the sections 49 and 50. FIGS. 8*c* and 8*d* illustrate the permanent sealing of channel 24 through rolling the end of channel 24 in a spiral configuration 55, ensuring a seal through compression of channel 24 that can be maintained by using an adhesive or pin in area 54. For the packaging system described in FIGS. 9*a*–9*c*, after the permanent seal of channel 24 in region 51 is made, channel 24 can be reinserted or tucked into box 34 through opening 40 and maintained therein by closing at 39 and sealing using conventional means such as tape, thus preventing damage of channel 24 during shipping.

Figure 8E:
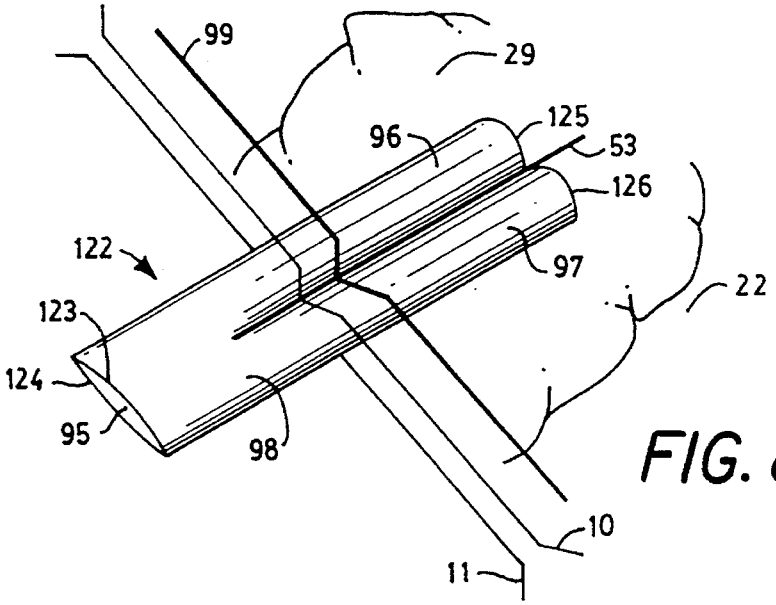

FIG. 8*e* illustrates a channel 122 that is inserted in between surfaces 10 and 11 to provide a filling channel for filling the chambers 22 and 29. Thermal seals are made between the surfaces 123 and 124 and the surfaces 10 and 11 by sealing along edges 99 and 124, respectively. Seals 99 and 124 extend along the perimeter of the material 14 in defining the chambers 22 and 29 of FIGS. 2*a* and 2*b*. Further, seal 21 is made to adhere layers 10, 123, 124 and 11 in order to separate the chambers 22 and 29, and create a "Y" valve as channel 24 in FIG. 2*a* and 2*b*. Filling of chambers 22 and 29 can be accomplished simultaneously through opening 95 and separate filling through channels 96 and 97. Permanent sealing of the channel is created by the positive pressure inside chambers 22 and 29 closing the channels 125 and 126. No additional clamps as in FIG. 8*b* and FIG. 8*d* are needed. Release of air from chambers 22 and 29 can be accomplished by inserting a straw or other hollow member through channels 96 and 97 and openings 125 and 126, respectively.

FIG. 9*a* illustrates the placement of the package 32, embodying the article 26 placed within the folded cushion bag 31, within the box 34. Channel 24 is bent outward at 25 so as to enable extrusion through the opening 40 during placement. Opening 40 may be formed as a standard form of box 34 or formed at the time of packaging with a tool such as a knife. In addition, opening 40 may be formed with a perforated edge that breaks upon applying pressure to area 39. Area 39 can be closed and sealed to surface 41 using a medium such as tape after the cushion bag 31 has been filled and sealed as shown in FIGS. 9*b* and 9*c*. FIG. 9*b* illustrates the disposition of the package 32 within the box 34 prior to filling as shown in FIG. 9*c*. In some applications, it may be advantageous first to partially fill the bag 31 and then proceed with sealing the box, using conventional means, as by the folding box panels 35, 37, 36, and 38. After box 34 is sealed, chambers 22 and 29 of the bag 31 are filled with pressurized air or other gas or fluid or filler 48 via a tube 45 and a pressure regulator and valve 46 and through the inflation opening 53 of channel 24. The pressure maintained within chambers 22 and 29 is made sufficient to suspend article 26 near the central portion of box 34. An air pressure of between 1 to 15 psi is usually sufficient to insure suspension of article 26 within box 34 and full inflation expansion in chambers 22 and 29 against the internal area of box 34.

Filling can also be performed by blowing through channel 24 or 122 by mouth. This tube may take the form of an injection molded plastic hollow section. After filling, the filler tube can be removed from opening 53 of channel 24 without excessive leakage from chambers 22 and 29 because of the temporary valve created in channel 24. This valve may be similar to that used in a "whoopee cushion" toy and is created by the expansion of chamber 22 and 29 and the sealing of the flat channel 24 in area 69 of FIG. 2. Use of the channel 122, FIG. 8*e* provides a permanent one-way valve that requires no additional clamp after filling is performed.

FIG. 10 illustrates a manufacturing assembly line for combining the modified flat bag 31 of the invention and a box 34 (or envelope 83) in a single unit. The unmodified material upper and lower planar sheet surfaces 10, 11 and 13 is rolled on a single or several spools 60 and fed along a predetermined path to the right. It is formed into the adjacent chambers illustrated in FIG. 2*a* and 2*b* via a stamping die 61. This die may use thermal means for sealing as well as adhesive means. In addition, adhesive areas 17 and 18 of form 31 may be applied with this die. One or more boxes 63 from shelving area 62 are partially opened and the flat bag 31 is inserted into each using assembly machine 64. Assembly mechanism 64 as well as die 61 may also be used to cut the successive flat bags 31 from the roll 60. The combined modified flat bag 31 and the box 34, or envelope 83 are subsequently stacked or shelved as a single unit 65 in shelving area 67.

Where box insertion is not desired, a roll(s) of successive pairs of adjacent flat bag chambers may be provided (22–29), FIG. 2*a* or FIG. 2*b*, each with its intermediate inflation channel 24 therebetween communicating at an inner end with the chambers, and having an outer end inflation opening (preferably independently sealable for each bag chamber at the outer end of the channel as before explained), as schematically illustrated by the dotted lines 120 in FIG. 10, after and above the die 61. At the same time, perforations or scoring lines 121, FIGS. 2*a* or 2*b*, between successive pairs of bag chambers may be introduced at the die 61 so that a user may tear successive flat double bag chambers units from the roll.

Further modifications will occur to those skilled in this art and such are considered to fall within the spirit and scope of the invention as defined in the appended claims.

What is claimed is:

1. An inflatable protective package for enveloping and cushioning articles for shipping or storage having, in combination, an initially substantially flat thin bag having upper and lower planar flexible surfaces peripherally sealed to form a pair of adjacent flat bag chambers intermediately joined by a common flat inflation channel therebetween extending between outer and inner ends and communicating at the inner end with the interior of each chamber, with the flat chambers being foldable along the inflation channel as a vertex fold to provide an angular space between the chambers for receiving therein the article-to-be-protected and with no portion of either chamber extending over the fold in order to provide pressure isolation between the chambers.

2. An inflatable protective package as claimed in claim 1 and in which the flat inflation channel is flexibly bendable out of the plane of the planar surfaces of the bag rearwardly of the vertex fold between the chambers to permit the outer end of the channel to be connected to a filling source independently to inflate the chambers and provide a protective cushion about the article.

3. An inflatable protective package as claimed in claim 1 and in which, sealing means is provided operable after the inflation of the chambers, for independently sealing the outer end of the channel.

4. An inflatable protective package as claimed in claim 2 and in which the flat chambers, as folded about the article, are provided with means for securing together the edges defining the angular space.

5. An inflatable protective package as claimed in claim 4 and in which the securing means comprises adhesive means disposed at a portion of one of the chambers defining an inner wall of the said angular space.

6. An inflatable protective package as claimed in claim 2 and in which means is provided for securing the chambers, as folded about the article, within and to an external box or package.

7. An inflatable protective package as claimed in claim 6 and in which the securing means comprises adhesive means disposed to hold an outer wall portion of the chambers to an adjacent portion of the external box or package.

8. An inflatable protective package as claimed in claim 1 and in which the flat chambers are of substantially rectangular shape with substantially rectangular corners, with their adjacent corners communicating with the inflation channel which extends from its inner end substantially parallel to the adjacent inner sides of the rectangles therebetween to an outer end filling opening.

9. An inflatable protective package as claimed in claim 8 and in which the corners of the rectangular shape are rounded.

10. An inflatable protective package as claimed in claim 8 and in which the inflation channel is provided with a divider partition forming adjacent inflation tubes for each of the chambers extending from a common filling opening at the outer end of the channel to enable independent filling and sealing for each chamber.

11. An inflatable protective package as claimed in claim 8 and in which the inflation channel is separable from said planar surfaces to permit bending its outer end out of the planar surfaces about its inner end.

12. An inflatable protective package as claimed in claim 11 and in which channel separation is effected by one of cutting and tearing perforations.

13. An inflatable protective package as claimed in claim 2 and in which the channel open end is adapted to connect to a source of gas or fluid, including air.

14. An inflatable protective package as claimed in claim 1 and in which the thin bag material is of gas-impermeable plastic sheeting.

15. An inflatable protective package as claimed in claim 14 and in which the peripheral seal is thermoformed.

16. An inflatable protective package as claimed in claim 10 and in which the dimension of the inflation channel filling opening is much smaller than the length of the inflation channel.

17. An inflatable protective package as claimed in claim 10 and in which means is provided for sealing each of the inflation channel tubes once the chambers have enclosed the article and have been filled.

18. Inflatable protective packages for enveloping articles for shipping or storage having, in combination, a roll of successive pairs of adjacent flat bag chambers, each with an intermediate inflation channel therebetween pressure-isolating the chambers and communicating at an inner end with the chambers and having an outer end inflation opening; and means between successive pairs of bag chambers for enabling severing the same from the rest of the roll.

19. Inflatable protective packages as claimed in claim 18 and in which sealing means is provided, operable following inflation, to effect one of independent sealing of the flat bag chambers of each pair at the outer end of the channel or self-seal valving.

20. An inflatable protective package comprising a pair of adjacently positioned similar inflatable packages for enveloping and cushioning different adjacent portions of an article for shipping or storage, each adjacent package having, in combination, an initially substantially flat thin bag having upper and lower planar flexible surfaces peripherally sealed to form a pair of adjacent flat bag chambers intermediately joined by a common flat inflation channel therebetween extending between outer and inner ends and communicating at the inner end with the interior of each chamber, with the flat chambers being foldable along the inflation channel as a vertex fold to provide an angular space between the chambers for receiving therein its portion of the article-to-be-protected, with no portion of either chamber extending over the fold in order to provide pressure isolation between the chambers.

21. An inflatable protective package comprising a pair of adjacent stacked similar inflatable protective packages for enveloping and cushioning articles for shipping or storage, each adjacent package having, in combination, an initially substantially flat thin bag having upper and lower planar flexible surfaces peripherally sealed to form a pair of adjacent flat bag chambers intermediately jointed by a common flat inflation channel therebetween extending between outer and inner ends and communicating at the inner end with the interior of each chamber, with the flat chambers being foldable along the inflation channel as a vertex fold to provide an angular space between the chambers for receiving therein the article-to-be-protected, with no portion of either chamber extending over the fold in order to provide pressure isolation between the chambers.

* * * * *